US005225845A

United States Patent [19]

Blaese

[11] Patent Number: 5,225,845

[45] Date of Patent: Jul. 6, 1993

[54] SLIP-ON PORTABLE ANTENNA

[76] Inventor: Herbert R. Blaese, 3314 Olcott Ave., Chicago, Ill. 60634

[21] Appl. No.: 718,803

[22] Filed: Jun. 21, 1991

[51] Int. Cl.[5] ..... H01Q 1/32

[52] U.S. Cl. ..... 343/715; 343/713; 343/888; 343/892

[58] Field of Search ..... 343/713, 715, 900, 711, 343/878, 888, 892, 829, 850

[56] References Cited

U.S. PATENT DOCUMENTS

| | | | |
|---|---|---|---|
| 4,658,259 | 4/1987 | Blaese | 343/715 |
| 4,692,770 | 9/1987 | Kadokura | 343/713 |
| 4,804,969 | 2/1989 | Blaese | 343/715 |
| 4,980,695 | 12/1990 | Blaese | 343/715 |
| 5,008,682 | 4/1991 | Blaese | 343/713 |
| 5,017,934 | 5/1991 | Blaese | 343/713 |

FOREIGN PATENT DOCUMENTS

| | | | |
|---|---|---|---|
| 1203227 | 2/1960 | France | 343/713 |
| 1227757 | 3/1960 | France | 343/715 |

*Primary Examiner*—Rolf Hille
*Assistant Examiner*—Hoanganh Le
*Attorney, Agent, or Firm*—Gerstman & Ellis, Ltd.

[57] ABSTRACT

A portable antenna is provided for mounting on a motor vehicle's side window and enabling easy and rapid mounting and removal. The portable antenna includes a base member with a current-fed radiator carried by the base member and having a first portion for location on the inside of the side window, a second contiguous portion for overlying the side window and a third portion, contiguous with the second portion, for location outside of the side window with a distal end thereof extending upwardly when in use. A field-canceling conductor is carried by the base portion for location on the inside of the side window. A coaxial cable has its main conductor connected to a proximal end portion of the current-fed radiator and has a ground conductor connected to the field-canceling member. The current-fed radiator is dimensioned so that the second portion thereof is a relatively low impedance area.

7 Claims, 2 Drawing Sheets

SLIP-ON PORTABLE ANTENNA

FIELD OF THE INVENTION

The present invention concerns a novel antenna, and more particularly, a portable antenna for mounting on the side window of a motor vehicle.

BACKGROUND OF THE INVENTION

In U.S. Pat. No. 4,658,259, a current-fed antenna is disclosed for mounting on a glass plate with a radiator extending from one side of the glass plate and with the electrical wire extending from the opposite side of the glass plate whereby energy is transferred through the glass plate and the drilling of a hole for coupling the radiator to the electrical wiring is unnecessary. On occasion it is desirable to have an antenna, useful with a cellular telephone in a motor vehicle, that is portable so that it may be easily and rapidly mounted and dismounted from the window of the vehicle.

In U.S. Pat. No. 5,017,934, a portable antenna is disclosed for mounting on a motor vehicle's side window and enabling easy and rapid mounting and removal. The portable antenna includes an outer RF transfer member, a current-fed radiator connected to the outer RF transfer member, an inner RF transfer member, a field-canceling member operative to cancel the electromagnetic field in the plane of the field-canceling member, and a pair of generally parallel wire members pivotally connecting the outer transfer member to the inner transfer member and bridging the inner and outer transfer members so as to overlie the side window when the antenna is mounted thereon.

Although the portable antenna disclosed in U.S. Pat. No. 5,017,934 has been found to be excellent for certain purposes, I have invented a portable antenna which can be less expensive to manufacture than the portable antenna of U.S. Pat. No. 5,017,934, and does not require separate wire members.

Therefore, an object of the present invention is to provide a portable antenna that is simple in construction and efficient to manufacture.

Another object of the present invention is to provide a current-fed antenna that is portable and alleviates many of the problems concomitant with prior art antennas.

Other objects and advantages of the present invention will become apparent as the description proceeds.

SUMMARY OF THE INVENTION

In accordance with the present invention, a portable antenna is provided for mounting on a motor vehicle's side window and enabling easy and rapid mounting and removal. The antenna comprises a base member, with the base member having means for carrying a current-fed radiator, means for carrying a field-canceling conductor, and means for carrying the proximal end portion of a coaxial cable.

A current-fed radiator is carried by the base member and has a first portion for location on the inside of the side window, a second contiguous portion for overlying the side window and a third portion, contiguous with the second portion, for location outside of the side window with the distal end thereof extending upwardly when in use.

A field-canceling conductor is carried by the base portion for location on the inside of the side window. A coaxial cable is carried by the base portion and has a main conductor and a ground conductor. The main conductor is connected to a proximal end portion of the current-fed radiator and the ground conductor is connected to the field-canceling member. The current-fed radiator is dimensioned so that the second portion of the radiator is a relatively low impedance area.

In the illustrative embodiment, the base member is formed of plastic and has means for at least partially overlying the side window. The current-fed radiator has a total electrical length of about $\frac{3}{4}$ wavelength, with the third portion being about $\frac{5}{8}$ wavelength and the combined first and second portions being about $\frac{1}{8}$ wavelength. In the illustrative embodiment, the radiator has a generally s-shape.

A more detailed explanation of the invention is provided in the following description and claims, and is illustrated in the accompanying drawing.

DETAILED DESCRIPTION OF THE ILLUSTRATIVE EMBODIMENTS

Figure 1:
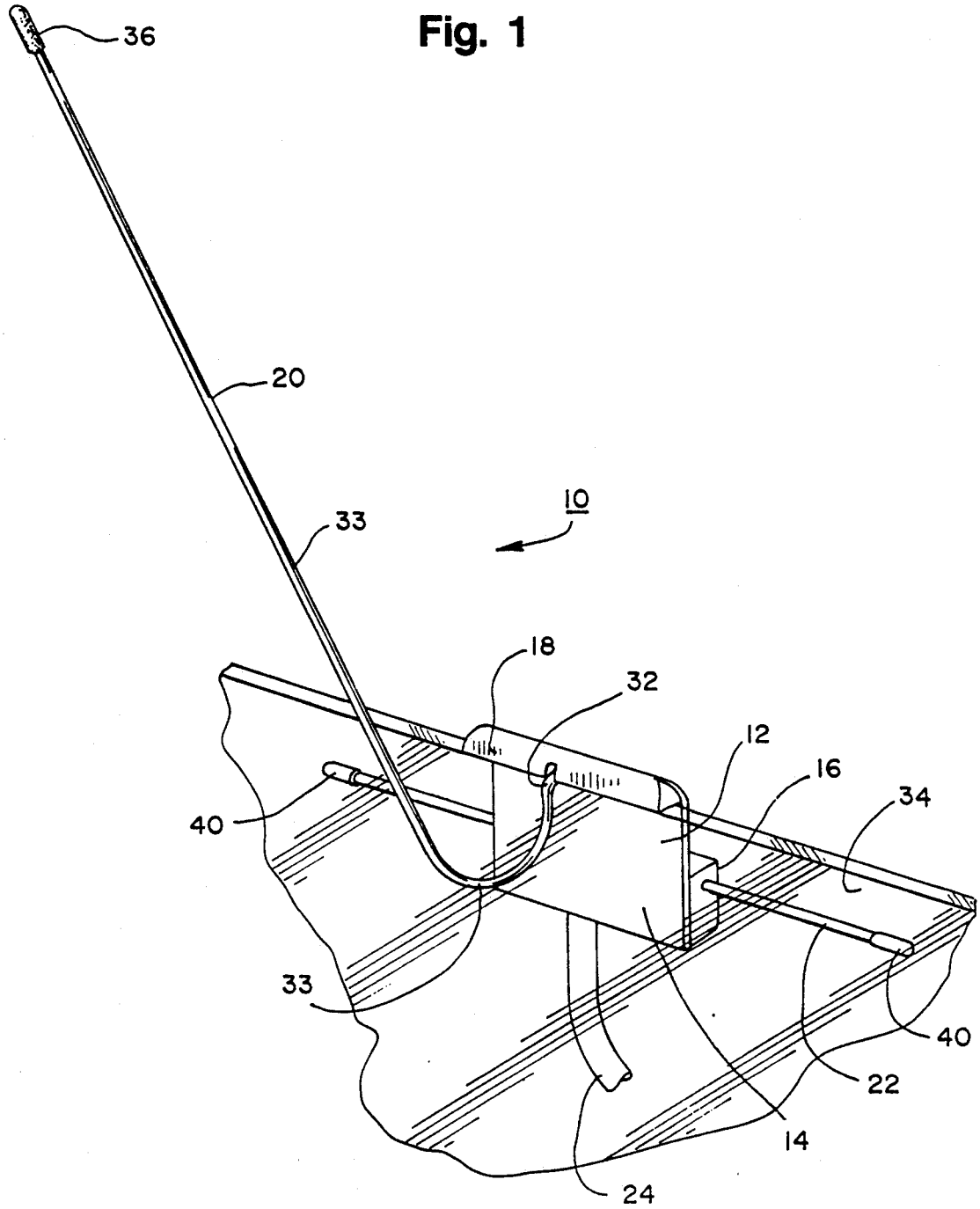
FIG. 1 is a perspective view of a portable antenna constructed in accordance with the principles of the present invention.

Referring to the Figures, a portable antenna 10 is shown therein having a plastic base member 12 formed of a planar inside portion 14, an outside box 16, and an overhang member 18.

Base member 12 has a slot 19 for carrying a current-fed radiator 20 the proximal end 21 of which extends into box 16. Box 16 defines openings for receiving a field-canceling conductor 22 which is operative to cancel the electromagnetic field in the plane of the field-canceling conductor 22 and which substitutes for a ground plane.

Box 16 also defines an opening for receiving a coaxial cable 24 which is a conventional 50 ohm coaxial cable having a main conductor 26 and a ground conductor 28. Main conductor 26 is connected to the proximal end 21 of radiator 20 and ground conductor 28 is connected to the mid-point 29 of field-canceling conductor 22. The connections are preferably via solder, and the solder is applied to the main conductor-radiator connection through a hole in box 16 which is thereafter filled.

Field-canceling conductor 22 is one-half wavelength from end to end, with ground conductor 28 being connected at its mid-point to provide two effective one-quarter wavelength field-canceling conductors. Coaxial cable 24 has a conventional coaxial cable connector 30 at its distal end.

As illustrated in the Figures, current-fed radiator 20 is generally S-shape in configuration and has a first portion 31 for location on the inside of the side window 34 of a motor vehicle, a second portion 32, contiguous with the first portion 31, for overlying the side window, and a generally J-shaped third portion 33, contiguous with the second portion 32, for location outside of the side window with the distal end 36 extending upwardly when the antenna is mounted on the vehicle in use.

Figure 2:
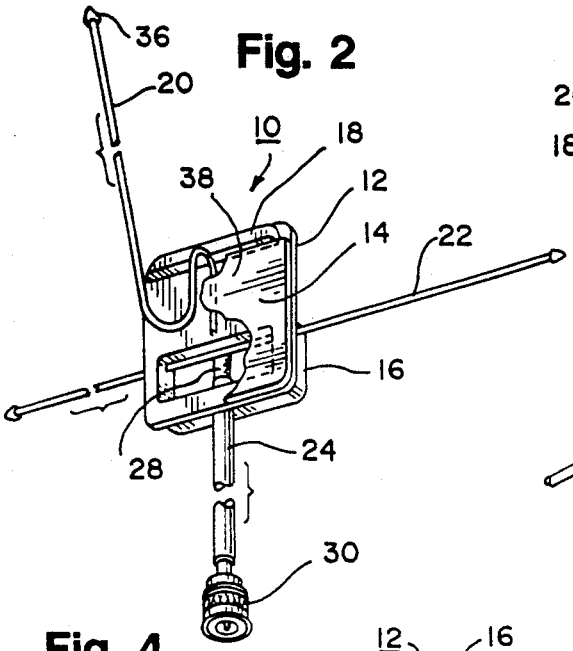
FIG. 2 is another perspective view thereof, showing the antenna with some of the inside cover.
Figure 3:
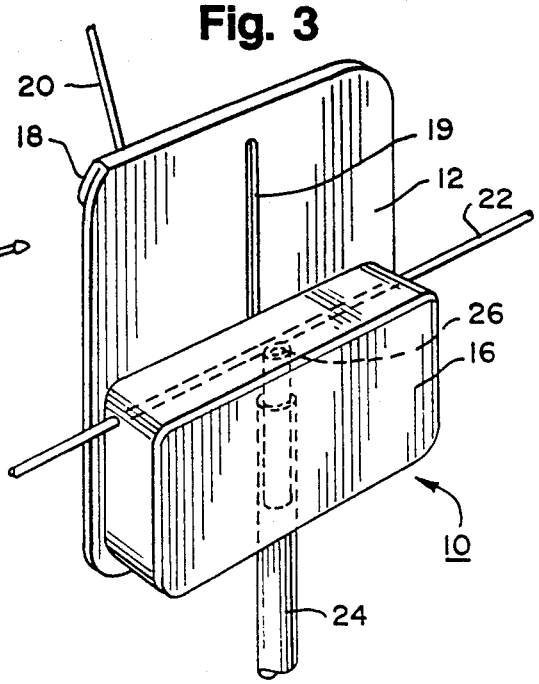
FIG. 3 is a perspective view of the base member of the portable antenna of the present invention.
Figure 4:
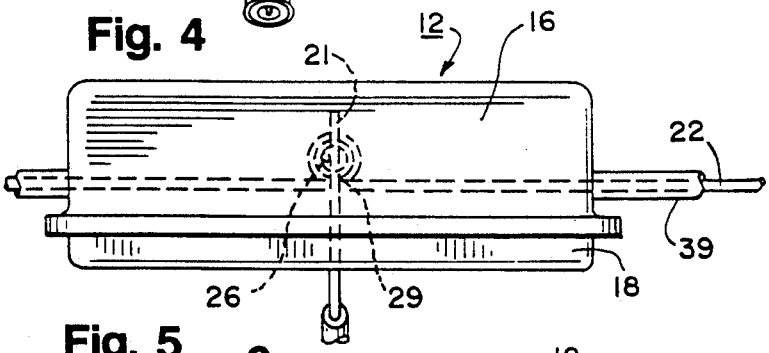
FIG. 4 is a plan view of a portable antenna constructed in accordance with the principles of the present invention.
Figure 5:
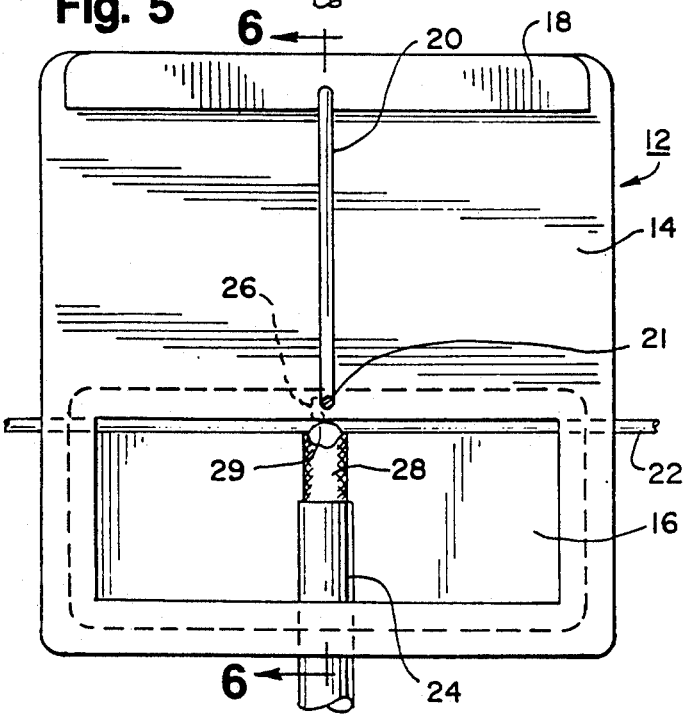
FIG. 5 is an elevational view of the inside of the base member, with the inside cover removed.
Figure 6:
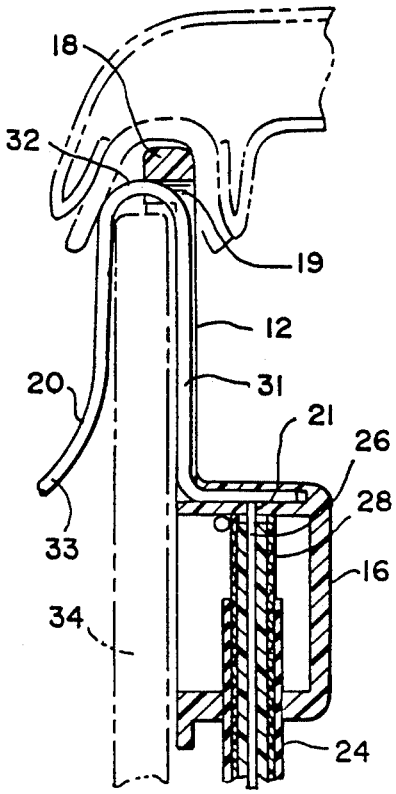
FIG. 6 is a cross-sectional view, taken along the plane of the line of 6—6 of FIG. 5.

As illustrated in FIG. 2, the inside 14 of base member 12 is covered with a thin plastic material 38 to provide a pleasing appearance. Field-canceling conductor 22 is covered with a plastic material 39 (FIG. 4) with soft-tipped ends 40 (FIG. 1) and the radiator 20 is also covered with a plastic material.

In the illustrative embodiment, radiator 20 forms a $\frac{3}{4}$ wavelength antenna. Thus the current-fed radiator 20 has a total electrical length of about $\frac{3}{4}$ wavelength. The third portion 33, which is generally J-shaped, is about $\frac{5}{8}$ wavelength and the combined first and second portions are about $\frac{1}{8}$ wavelength. The low impedance current point is in the area around the proximal end of the radiator. At the second portion 32 of radiator 20, the impedance is still relatively low so that even when the side window is closed, reception and transmission will not be significantly affected. It is critical that the second portion 32 not be a high impedance area in order to prevent reception or transmission problems when the side window is rolled up.

Although no limitation is intended, the illustrative embodiment is useful in the cellular telephone field having a frequency of 825–895 MHz, with a 3 db gain and a nominal impedance of 50 ohms, a maximum power of 50 watts and a bandwidth of 80 MHz. The radiator is preferably formed of 17–7 stainless steel with copper and black protective coating, with a radiator length of about 9 inches (23 centimeters), and with the base member 12 of formed ABS plastic. The coaxial cable is preferably RG 58 A/U stranded cable, 8 feet (2.4 m) in length, with coaxial cable connector 30 installed.

It is to be understood that the entire first one-half wavelength of the radiator could be located on the inside of the window, so long as a relatively low impedance area is located at the top of the window. Although an illustrative embodiment of the invention has been shown and described, it is to be understood that various modifications and substitutions may be made by those skilled in the art without departing from the novel spirit and scope of the present invention.

I claim:

1. A portable antenna for transmitting and receiving in the cellular frequency band adapted for mounting on a motor vehicle's side window and enabling easy and rapid mounting and removal, which comprises:

a base member generally formed of plastic, said base member having means for carrying a current fed radiator, means for carrying a field-canceling conductor, means for at least partially overlying the side window, and means for carrying the proximal end portion of a coaxial cable;

said current-fed radiator carried by said base member and having a first portion for location on the inside of the side window, a second contiguous portion for overlying the side window, and a third portion, contiguous with said second portion, for location outside of the side window with the distal end thereof extending upwardly when in use;

a field-canceling conductor carried by said base portion for location on the inside of the side window;

a coaxial cable carried by the base portion and having a main conductor and a ground conductor;

means connecting said main conductor to a proximal end portion of said current fed radiator;

means connecting said ground conductor to said field-canceling member;

said current-fed radiator being dimensioned so that said second portion of said radiator is a relatively low impedance area.

2. A portable antenna a defined by claim 1, said field-canceling conductor being approximately one-half electrical wavelength from end to end with said ground conductor being connected at about its mid-point.

3. A portable antenna as defined by claim 1, said field-canceling conductor comprising a first quarter wavelength member and a second quarter wavelength member with said ground conductor connected to proximal ends of said first and second quarter wavelength members.

4. A portable antenna as defined by claim 1, said current-fed radiator having a total electrical length of about three-quarter wavelength.

5. A portable antenna as defined by claim 4, said third portion being about $\frac{5}{8}$ wavelength and the combined first and second portions being $\frac{1}{8}$ wavelength.

6. A portable antenna as defined by claim 1, said base member having a box member for location on the inside of the window, said box member enclosing a portion of said field-canceling member, a portion of said cable and the proximal end of said current-fed radiator.

7. A portable antenna for transmitting and receiving in the cellular frequency band adapted for mounting on a motor vehicle's side window and enabling easy and rapid mounting and removal, which comprises:

a base member, said base member being generally formed of plastic and having means for at least partially overlying the side window;

said base member having means for carrying a current-fed radiator, means for carrying a field-canceling conductor, and means for carrying the proximal end portion of a coaxial cable;

said current-fed radiator carried by said base member and having a first portion for location on the inside of the side window, a second contiguous portion for overlying the side window and a third portion, contiguous with said second portion, for location outside of the side window with the distal end thereof extending upwardly when in use;

a field-canceling conductor carried by said base portion and for location on the inside of the side window;

a coaxial cable carried by the base portion and having a main conductor and a ground conductor;

means connecting said main conductor to a proximal end portion of said current fed radiator;

means connecting said ground conductor to said field-canceling member;

said current-fed radiator being dimensioned so that said second portion of said radiator is not a high impedance area.

* * * * *